US007922301B2

(12) United States Patent
Sugahara

(10) Patent No.: US 7,922,301 B2
(45) Date of Patent: Apr. 12, 2011

(54) LIQUID TRANSPORT APPARATUS AND METHOD FOR PRODUCING LIQUID TRANSPORT APPARATUS

(75) Inventor: Hiroto Sugahara, Aichi-ken (JP)

(73) Assignee: Brother Kogyo Kabushiki Kaisha, Nagoya-shi, Aichi-ken (JP)

( * ) Notice: Subject to any disclaimer, the term of this patent is extended or adjusted under 35 U.S.C. 154(b) by 252 days.

(21) Appl. No.: 12/390,370

(22) Filed: Feb. 20, 2009

(65) Prior Publication Data

US 2009/0219347 A1 Sep. 3, 2009

(30) Foreign Application Priority Data

Feb. 29, 2008 (JP) ..... 2008-050291

(51) Int. Cl.
*B41J 2/045* (2006.01)

(52) U.S. Cl. ..... 347/70

(58) Field of Classification Search ..... 347/70–71
See application file for complete search history.

(56) References Cited

U.S. PATENT DOCUMENTS

2005/0270339 A1 12/2005 Sugahara

FOREIGN PATENT DOCUMENTS

JP 2005-349568 A 12/2005

*Primary Examiner* — K. Feggins
*Assistant Examiner* — Lisa M Solomon
(74) *Attorney, Agent, or Firm* — Baker Botts L.L.P.

(57) ABSTRACT

A piezoelectric actuator includes a vibration plate, a plurality of individual electrodes, wiring sections each extending from corresponding one of the individual electrodes and passing between the other individual electrodes other than the corresponding individual electrode, a piezoelectric layer arranged on the vibration plate to cover the individual electrodes, and a common electrode arranged on a surface of the piezoelectric layer disposed on a side opposite to the piezoelectric layer. At least portions of the plurality of wiring sections, each of which is allowed to pass between the another individual electrodes, are covered with a second insulating layer. Accordingly, it is possible to suppress the occurrence of the strain of the piezoelectric layer in the area between the individual electrodes through which the wiring section is allowed to pass, without providing any complicated shape of the common electrode in which the common electrode is partially cut out.

16 Claims, 12 Drawing Sheets

LIQUID TRANSPORT APPARATUS AND METHOD FOR PRODUCING LIQUID TRANSPORT APPARATUS

CROSS REFERENCE TO RELATED APPLICATION

The present application claims priority from Japanese Patent Application No. 2008-050291, filed on Feb. 29, 2008 the disclosures of which are incorporated herein by reference in its entirety.

BACKGROUND OF THE INVENTION

1. Field of the Invention

The present invention relates to a liquid transport apparatus for transporting a liquid, and a method for producing the liquid transport apparatus.

2. Description of the Related Art

An ink-jet head, which jets an ink liquid from nozzles, has been hitherto known as a liquid transport apparatus for transporting the liquid, the ink-jet head including a channel unit which is provided with a plurality of pressure chambers communicated with the nozzles respectively, and a piezoelectric type actuator which selectively applies the pressure to the plurality of pressure chambers.

An ink-jet head described in Japanese Patent Application Laid-open No. 2005-349568 includes a piezoelectric actuator which is arranged on one surface of a channel unit to cover a plurality of pressure chambers therewith. The piezoelectric actuator has a vibration plate which covers the plurality of pressure chambers, a piezoelectric layer which is arranged to cover the plurality of pressure chambers on the surface of the vibration plate disposed on the side opposite to the pressure chambers, a plurality of individual electrodes which are arranged on the piezoelectric layer corresponding to the plurality of pressure chambers respectively, and a common electrode which interposes the piezoelectric layer between the common electrode and the plurality of individual electrodes.

The plurality of individual electrodes are provided on the surface of the vibration plate made of metal with an insulating layer intervening therebetween. The plurality of individual electrodes are in contact with the piezoelectric layer. Wiring sections are led from the plurality of individual electrodes respectively. Each of the wiring sections is laid out, on the surface of the vibration plate (insulating layer), to pass between another individual electrodes which are different from the corresponding individual electrode. The common electrode is provided on the surface, of the piezoelectric layer, not facing the vibration plate to range over the plurality of pressure chambers. The common electrode is always retained at the constant electric potential (ground electric potential). When a predetermined driving voltage is applied via one of the wiring sections to a certain individual electrode among the individual electrodes, the piezoelectric strain arises at the portion, of the piezoelectric layer, interposed by the certain individual electrode and the common electrode. Accordingly, the vibration plate is deformed, the volume of the pressure chamber corresponding to the certain individual electrode is changed, and the pressure is applied to the ink contained in the pressure chamber.

In this arrangement, when the driving electric potential is applied to one of the individual electrodes corresponding to a certain pressure chamber in order to drive the certain pressure chamber (in order to apply the pressure to the ink), the electric potential is necessarily applied simultaneously to the wiring section which is connected to the individual electrode as well.

As a result, the electric potential difference is generated between the wiring section and the common electrode, and the piezoelectric strain arises in the piezoelectric layer in an area which is disposed between the another individual electrodes and through which the wiring section is allowed to pass. In this situation, the driving characteristics of another pressure chambers corresponding to the another individual electrodes are changed by being affected by the piezoelectric strain. In view of the above, in the case of the piezoelectric actuator described in Japanese Patent Application Laid-open No. 2005-349568, the areas, of the common electrode, facing the wiring sections are partially cut. Therefore, the electric field is not allowed to act on the piezoelectric layer between the common electrode and the wiring sections.

SUMMARY OF THE INVENTION

The common electrode applies the common electric potential to all of the individual electrodes. In view of the stabilization of the common electric potential, it is preferable that the common electrode is formed entirely on the surface of the piezoelectric layer. In other words, if the areas of the common electrode, which are opposed to the wiring sections, are partially cut as in the piezoelectric actuator described in Japanese Patent Application Laid-open No. 2005-349568, the shape of the common electrode is complicated. The electric potential of the individual electrode is frequently changed during the driving of the piezoelectric actuator. Therefore, a problem arises such that the electric potential of the common electrode tends to be locally unstable, and the driving stability of the piezoelectric actuator is deteriorated.

An object of the present invention is to provide a liquid transport apparatus and a method for producing the liquid transport apparatus, wherein it is possible to suppress the occurrence of the strain of a piezoelectric layer in an area between individual electrodes through which any wiring section is allowed to pass, without providing any complicated shape of a common electrode in which the common electrode is partially cut out.

According to a first aspect of the present invention, there is provided a liquid transport apparatus which transports a liquid, including:

a channel unit in which a liquid channel including a plurality of pressure chambers arranged along a plane is formed; and a piezoelectric actuator which applies a pressure to the liquid in each of the pressure chambers, the piezoelectric actuator including:

- a vibration plate which is arranged on a surface of the channel unit to cover the pressure chambers and one surface of which has an insulation property, the one surface not facing the pressure chambers;
- a plurality of individual electrodes which are arranged on the one surface of the vibration plate at areas facing the pressure chambers, respectively, to define inter-electrode areas each of which is defined between two adjacent individual electrodes, among the individual electrodes;
- a plurality of wirings which are arranged on the one surface of the vibration plate, the wirings extending from the respective individual electrodes and passing the inter-electrode areas;
- a piezoelectric layer which is arranged, on a side, of the vibration plate, not facing the pressure chambers, to be overlapped with the individual electrodes and portions of the wirings passing the inter-electrode areas;

a common electrode which is arranged on one surface, of the piezoelectric layer, not facing the vibration plate to be overlapped with the individual electrodes and the portions of the wirings passing the inter-electrode areas; and an insulating layer which is arranged between the wirings and the common electrode to be overlapped with the portions of the wirings passing the inter-electrode areas.

In the first aspect of the present invention, the wirings, each of which is led from one of the individual electrodes, is allowed to pass between the areas each of which is defined between two adjacent individual electrodes among the individual electrodes. In other words, the wiring is disposed closely to the area (active area) which is opposed to another individual electrode and in which the piezoelectric strain is generated. In view of the above, in the present invention, at least the portion of each of the wirings, which is allowed to pass between the individual electrodes, is overlapped with the insulating layer. Therefore, even when the common electrode is opposed to the wiring, any electric field is not allowed to act on the piezoelectric layer disposed between the wiring and the common electrode. The occurrence of the piezoelectric strain is suppressed. Therefore, it is unnecessary for the common electrode to have any complicated shape in which the common electrode is partially cut out in the area opposed to the wiring as in the conventional arrangement. In other words, according to the present invention, it is possible to suppress the occurrence of the strain in the piezoelectric layer in the area between the adjoining individual electrodes, and at the same time, it is possible to stabilize the electric potential of the common electrode.

The insulating layer is allowed to intervene between the wirings and the common electrode. Accordingly, the areas, of the upper surface of the piezoelectric actuator (upper surface of the common electrode), which are overlapped with the wirings and which are arranged on the outer side of the active areas overlapping with the individual electrodes (area overlapped with the active area of the piezoelectric layer), are bulged. In other words, the portion, of the surface of the piezoelectric layer, which corresponds to the active area of the piezoelectric layer, is one step lower than the surroundings thereof. Therefore, the active area, which is the portion to apply the pressure to the liquid contained in the pressure chamber, is hardly damaged.

In the liquid transport apparatus of the present invention, the insulating layer may be arranged to directly cover the portions (the inter-electrodes portions) of the wirings passing the inter-electrode areas. In this arrangement, the inter-electrodes portions of the wirings can be reliably covered with the insulating layer. It is possible to suppress the occurrence of the strain in the piezoelectric layer in the areas disposed between the adjoining individual electrodes. In particular, the insulating layer is allowed to intervene between the wirings and the piezoelectric layer. Accordingly, the piezoelectric layer is bulged at the areas in which the wirings are arranged and which are disposed on the outer side of the active areas in which the individual electrodes are arranged. In other words, the surface of the piezoelectric layer in the active areas is one step lower than the surroundings thereof. Therefore, the active areas, which are the portions to apply the pressure to the liquid in the pressure chambers, are hardly damaged.

In the liquid transport apparatus of the present invention, first areas and a second area may be formed on a surface of the common electrode not facing the piezoelectric layer, the first areas being formed to overlap with the individual electrodes, and to be located at a position lower, in a direction directed from the vibration plate to the common electrode, than the second area which is overlapped with the insulating layer. Also in this arrangement, the insulating layer is allowed to intervene between the wirings and the common electrode. Therefore, the second area, which is overlapped with the insulating layer and which is disposed on the outer side of the pressure chambers, is bulged in an amount corresponding to the thickness of the insulating layer as compared with the first areas of the common electrode which overlap with the individual electrodes. In other words, the portions of the surface of the common electrode, which are overlapped with the active areas of the piezoelectric layer, is one step lower than the surroundings thereof. Therefore, the active areas, which are the portions to apply the pressure to the liquid in the pressure chambers, are hardly damaged.

In the liquid transport apparatus of the present invention, the second area of the common electrode may be arranged to surround a circumference of each of the first areas, and each of the first areas of the common electrode may be formed as a recess. Also in this arrangement, the entire portion of the surface of the common electrode, which is overlapped with the active area of the piezoelectric layer, is the recess which is one step lower than the surroundings thereof. Therefore, the active area, which is the portions to apply the pressure to the liquid contained in the pressure chambers, are hardly damaged.

In the liquid transport apparatus of the present invention, an area of the wiring, which is overlapped with the piezoelectric layer, may be entirely covered with the insulating layer.

In this arrangement, when the driving electric potential, which is different from the electric potential of the common electrode, is applied to the wiring, it is possible to reduce the parasitic capacitance generated in the piezoelectric layer disposed between the wiring and the common electrode.

In the liquid transport apparatus of the present invention, the piezoelectric layer may be arranged in only a partial area of the one surface of the vibration plate;

each of the wirings may extend to an area, of the one surface of the vibration plate, in which the piezoelectric layer is absent; and each of the wirings may be covered with the insulating layer also in the area in which the piezoelectric layer is absent.

In this arrangement, the wirings extend from the area in which the piezoelectric layer is arranged to the area in which the piezoelectric layer is not arranged on the surface of the vibration plate. The wirings are also covered with the insulating layer in the area in which the piezoelectric layer is not arranged. Therefore, the portions of the wirings, which are not covered with the piezoelectric layer, are protected by the insulating layer. Further, any short circuit formation between the wirings is also avoided by the insulating layer.

In the liquid transport apparatus of the present invention, the partial area of the vibration plate, in which the piezoelectric layer is arranged, may be fixed to the surface of the channel unit; and another area of the vibration plate, which is different from the partial area, may extend toward outside of the channel unit, and a driving circuit, which is connected to the plurality of wirings and which applies a driving voltage between the individual electrodes and the common electrode, may be provided on the another area.

In this arrangement, the partial area of the vibration plate is secured to the channel unit, the vibration plate extends to the outside from the channel unit in the other area to lead the wires, and the driving circuit is carried to be used as a wiring board or circuit board. The piezoelectric layer is not formed at the portion of the vibration plate which extends from the channel unit to the outside and which is used as the wiring board. Therefore, the portion, which is used as the wiring board, can be thinned as far as possible so that the portion can be curved and laid out with ease.

In the liquid transport apparatus of the present invention, the insulating layer may be arranged, on the one surface of the vibration plate, to surround the individual electrodes.

The insulating layer is formed not only in the areas in which the wirings are arranged, but the insulating layer is also formed to surround the individual electrodes as described above. Therefore, the portion of the upper surface of the piezoelectric layer, which is overlapped with the surrounding area of the individual electrode, is bulged over the entire circumference thereof as compared with the area in which the individual electrode is arranged. The piezoelectric layer, which is in the active area opposed to the individual electrode, is damaged more scarcely.

In the liquid transport apparatus of the present invention, a portion of each of the wirings may be formed in areas facing another pressure chambers corresponding to the another individual electrodes; and the insulating layer may be formed on the one surface of the vibration plate at only areas which face the another pressure chambers and in which the wirings are arranged.

In this arrangement, when the respective wirings are arranged partially opposingly to the another pressure chambers corresponding to the another individual electrodes, the areas, in which the wirings can be arranged, are widened. Therefore, a larger number of the wirings can be allowed to pass between the two individual electrodes which are adjacent to one another while providing a predetermined spacing distance therebetween. The wirings can be laid out with ease, and the individual electrodes and the pressure chambers, which correspond thereto, can be arranged at a higher density. However, in view of the fact that the deformation of the vibration plate and the piezoelectric layer is facilitated in the areas opposed to the respective pressure chambers to increase the amount of displacement of the entire actuator, it is desirable that the thickness of the actuator is decreased as small as possible in the areas opposed to the pressure chambers. Therefore, it is intended that the area, in which the insulating layer is provided, is decreased as small as possible. Accordingly, in the present invention, the insulating layer is arranged in only the areas in which the wirings are provided, of the areas which are opposed to the pressure chambers. Accordingly, it is possible to suppress the decrease in the amount of displacement of the actuator, which would be otherwise caused by the provision of the insulating layer.

In the liquid transport apparatus of the present invention, the insulating layer may be arranged also in areas, between the wirings and the common electrode, not overlapped with the plurality of wirings. In this arrangement, the degree of freedom of the arrangement can be enhanced, for example, when the insulating layer is formed.

In the liquid transport apparatus of the present invention, the recess of the piezoelectric actuator may have a depth of 1 to 4 μm. The dust or the like, which flows in the general clean room, has a diameter of not more than about 1 μm. Therefore, even when such dust is stick onto the recess, then there is no fear of any flying of the dust out of the recess, and there is no fear of any biting of the recess into the recess during the operation, because the depth of the recess is 1 to 4 μm. Therefore, there is no fear of any breakage of the driving area overlapped with the recess of the piezoelectric actuator.

In the liquid transport apparatus of the present invention, the vibration plate may have a metal substrate which is arranged to face the pressure chambers, and an insulating film which is formed on a surface of the substrate not facing the pressure chambers. In this arrangement, the vibration plate has the substrate made of metal, and hence the vibration plate can possess the sufficient rigidity. Further, the vibration plate has the insulating film on the surface, and hence the vibration plate can possess the insulating property.

In the liquid transport apparatus of the present invention, the insulating film may be formed of a ceramics material. In this arrangement, the insulating film can be used as a barrier layer for avoiding the diffusion of atoms from the metal substrate. After the piezoelectric layer is formed on the vibration plate, the stack of the vibration plate and the piezoelectric layer is sometimes heated to a high temperature (for example, about 850° C.) in order to anneal the piezoelectric layer. In this procedure, if the metal atoms are diffused to the piezoelectric layer from the substrate made of metal of the vibration plate, the piezoelectric characteristic of the piezoelectric layer is deteriorated. In such a situation, when the insulating film, which is formed of the ceramics material, is arranged between the piezoelectric layer and the substrate of the vibration plate, it is possible to suppress the diffusion of the metal atoms from the substrate made of metal toward the piezoelectric layer. Those preferably usable as the ceramics material include, for example, alumina, zirconia, and silicon nitride. When the insulating film is formed on the metal substrate by means of the AD method, then it is possible to form the densified film, and it is possible to enhance the barrier performance of the film.

According to a second aspect of the present invention, there is provided a method for producing a liquid transport apparatus including a channel unit having a liquid channel formed therein and including a plurality of pressure chambers arranged along a plane, and a piezoelectric actuator which applies a pressure to a liquid in each of the pressure chambers, the method including:

providing the channel unit;

arranging a vibration plate on a surface of the channel unit to cover the plurality of pressure chambers, one surface of the vibration plate not facing the pressure chambers having an insulation property;

forming a plurality of individual electrodes on the one surface of the vibration plate at areas to be faced to the plurality of pressure chambers respectively;

forming a plurality of wirings on the one surface of the vibration plate to extend from the respective individual electrodes such that the wirings passes through inter-electrode areas each of which is defined between two adjacent individual electrodes among the individual electrodes;

forming a piezoelectric layer on the one surface of the vibration plate such that the piezoelectric layer is overlapped with the individual electrodes and portions of the wirings passing the inter-electrode areas;

forming a common electrode on a surface of the piezoelectric layer not facing the vibration plate such that the common electrode is overlapped with the individual electrodes; and forming an insulating layer between the common electrode and the wirings such that the insulating layer is overlapped with the portions, of the wirings, passing the inter-electrode areas.

According to the second aspect of the present invention, the portion of each of the wirings, which is allowed to pass at least between the individual electrodes, is covered with the insulating layer. Therefore, it is unnecessary to partially cut out the common electrode in order that the piezoelectric strain is not generated in the piezoelectric layer in the areas between the individual electrodes. Therefore, it is possible to suppress the occurrence of the strain in the piezoelectric layer in the areas between the adjoining individual electrodes while stabilizing the electric potential of the common electrode.

Further, the insulating layer is allowed to intervene between the wirings and the common electrode. Accordingly, the areas of the upper surface of the piezoelectric actuator (common electrode surface), which are overlapped with the wirings and which are arranged on the outer side as compared with the area overlapped with the individual electrode (area overlapped with the active area of the piezoelectric layer), are bulged. In other words, the portion of the surface of the piezoelectric layer, which corresponds to the active area of the piezoelectric layer, is one step lower than the surroundings thereof. Therefore, the active area, which is the portion to apply the pressure to the liquid contained in the pressure chamber, is hardly damaged.

In the method for producing the liquid transport apparatus of the present invention, the insulating layer may be formed to directly cover the portions, of the wirings, passing the inter-electrode areas.

In this case, in particular, the insulating layer is allowed to intervene between the wirings and the piezoelectric layer. Accordingly, the piezoelectric layer is bulged in the areas in which the wirings are arranged and which are disposed on the outer side as compared with the area (active area) in which the individual electrode is arranged. In other words, the surface of the piezoelectric layer in the active area is one step lower than the surroundings thereof. Therefore, the active area, which is the portion to apply the pressure to the liquid contained in the pressure chamber, is hardly damaged.

In the method for producing the liquid transport apparatus of the present invention, the insulating layer may be formed by an aerosol deposition method.

The aerosol deposition (AD) method is such a film formation method that a mixture (aerosol) of a gas (carrier gas) and particles for forming the film is allowed to blow against a substrate as a film formation objective, and the particles are deposited on the substrate by allowing the particles to collide with the substrate at a high velocity. The densified insulating layer, which has a high mechanical strength, can be formed by using the AD method.

According to the present invention, the insulating layer is formed to overlap with the portions, of the wirings, passing the inter-electrode areas. Therefore, it is unnecessary to partially cut out the common electrode in the areas opposed to the wirings in order that no piezoelectric strain is generated in the piezoelectric layer in the areas in which the wirings are arranged. Therefore, it is possible to suppress the occurrence of the piezoelectric strain in the areas between the individual electrodes through which the wirings are allowed to pass, while stabilizing the electric potential of the common electrode.

Further, for example, when the insulating layer is allowed to intervene between the wirings and the piezoelectric layer, the piezoelectric layer is bulged in the areas in which the wirings are arranged, the areas being arranged on the outer side as compared with the area (active area) in which the individual electrode is arranged. In other words, the surface of the piezoelectric layer in the active area is one step lower than the surrounding areas thereof. Therefore, the active area, which is the portion to apply the pressure to the liquid contained in the pressure chamber, is hardly damaged.

BRIEF DESCRIPTION OF THE DRAWINGS

FIGS. 7A to 7D show first half steps of a method for producing the ink-jet head, wherein FIG. 7A shows a plate-joining step, FIG. 7B shows a first insulating layer-forming step, FIG. 7C shows an individual electrode-forming step and a wiring section-forming step, and FIG. 7D shows a second insulating layer-forming step.

FIGS. 8A to 8C show latter half steps of the method for producing the ink-jet head, wherein FIG. 8A shows a piezoelectric layer-forming step, FIG. 8B shows a common electrode-forming step, and FIG. 8C shows a nozzle plate-joining step.

DESCRIPTION OF THE PREFERRED EMBODIMENTS

Next, an embodiment of the present invention will be explained. This embodiment is an example in which the present invention is applied to an ink-jet head as a liquid transport apparatus which transports the inks to the nozzles through ink channels to jet droplets of the inks from nozzles.

Figure 1:
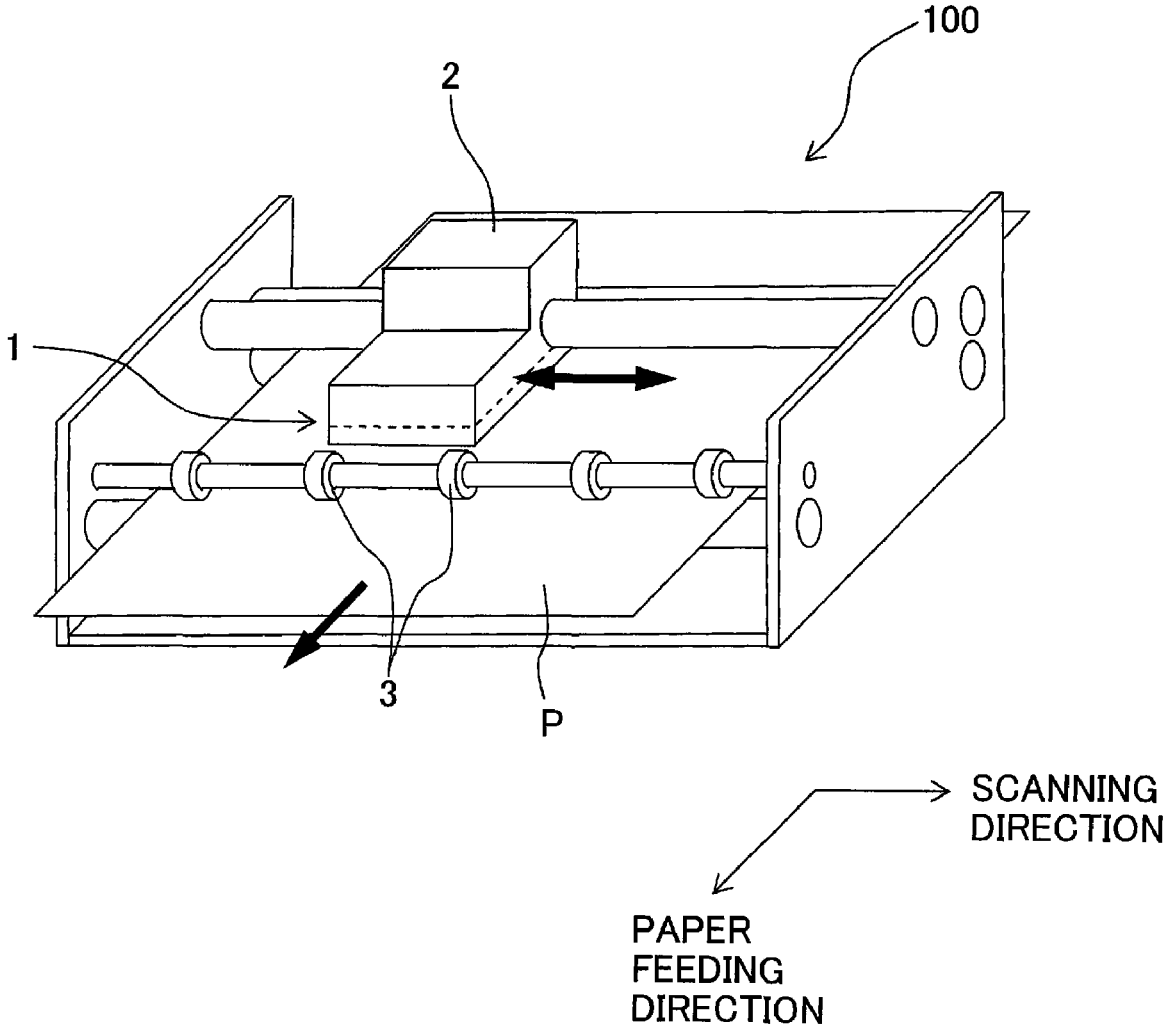
FIG. 1 shows a schematic arrangement of an ink-jet printer according to an embodiment of the present invention.

At first, an explanation will be made about a printer provided with the ink-jet head. FIG. 1 shows a schematic arrangement of the printer. As shown in FIG. 1, the ink-jet printer 100 includes, for example, a carriage 2 which is reciprocatively movable in the left-right direction (scanning direction) as viewed in FIG. 1, the serial type ink-jet head 1 which is provided on the carriage 2 and which discharges the inks to the recording paper P, and a transport roller 3 which transports the recording paper P in the frontward direction as viewed in FIG. 1.

In the ink-jet printer 100, the ink-jet head 1 jets the inks to the recording paper P from the nozzles 20 (see FIGS. 3 to 6) of the ink-jet head 1, while the ink-jet head 1 is reciprocatively moved in the scanning direction together with the carriage 2. For example, any desired image and/or letters are recorded on the recording paper P, and the recording paper P, on which the image or the like has been recorded, is discharged in the frontward direction by means of the transport roller 3.

Figure 2:
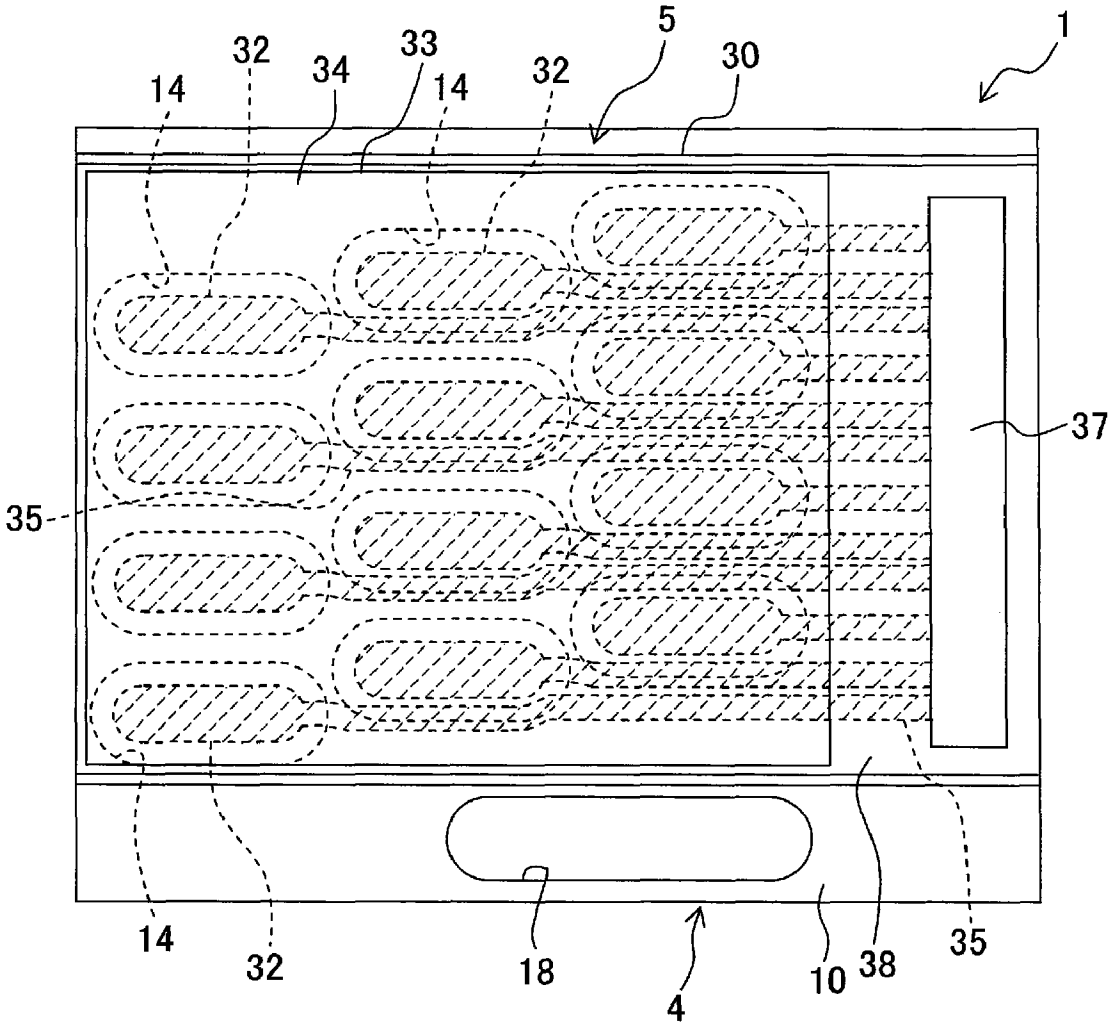
FIG. 2 shows a plan view illustrating an ink-jet head.
Figure 3:
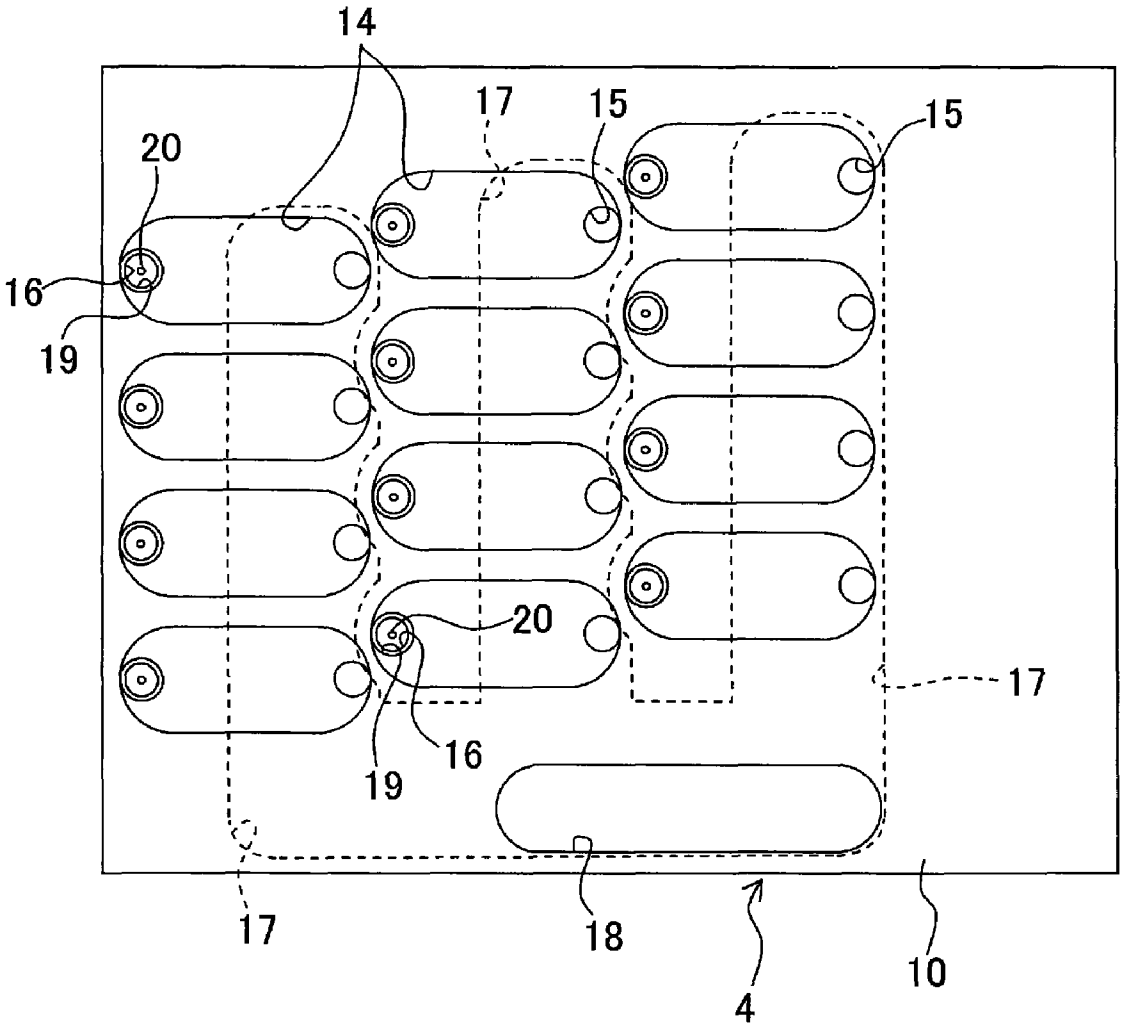
FIG. 3 shows a plan view illustrating a channel unit.
Figure 4:
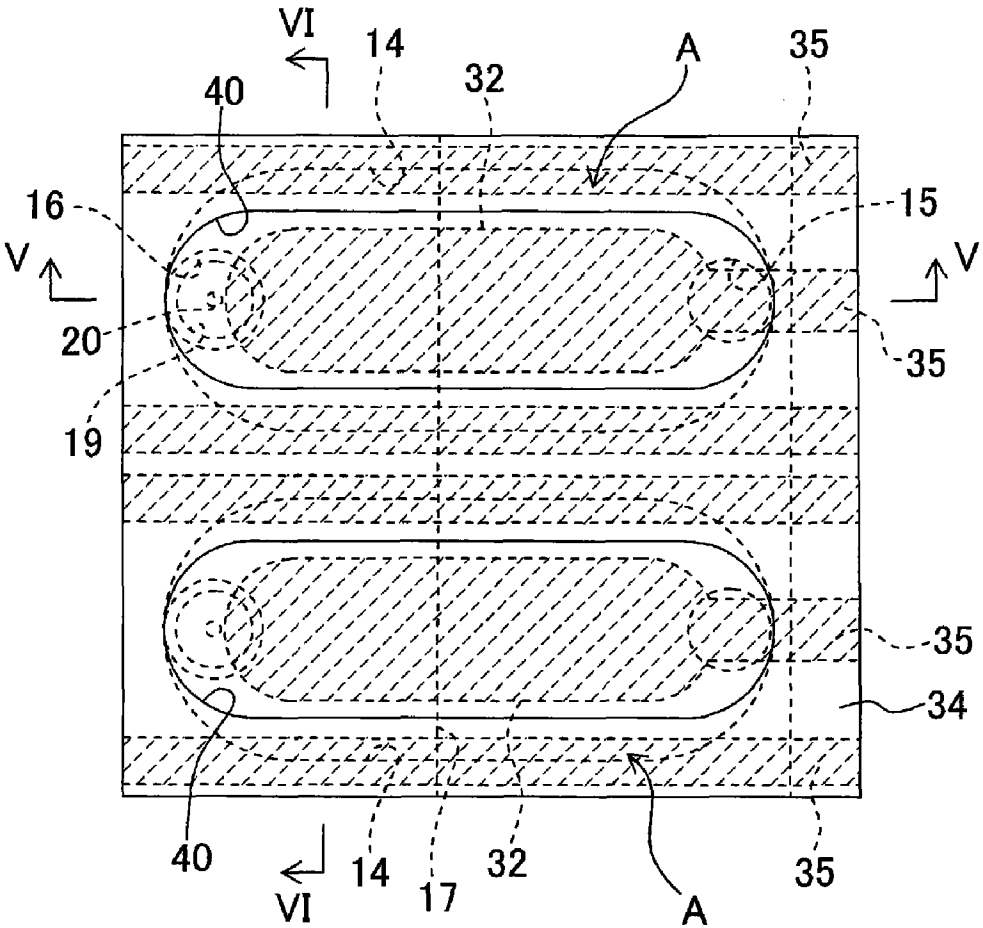
FIG. 4 shows a partial magnified plan view illustrating those shown in FIG. 2.
Figure 5:
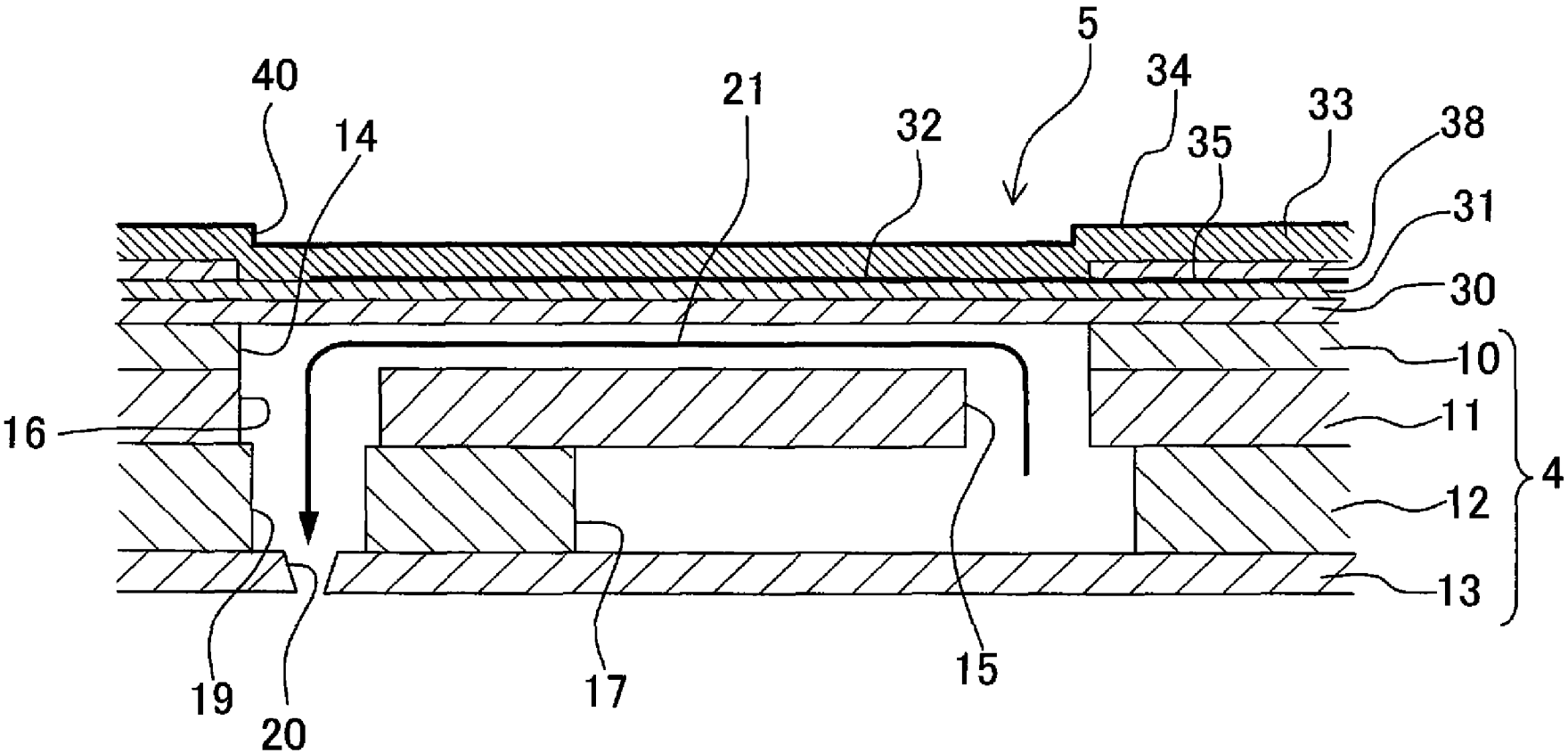
FIG. 5 shows a sectional view taken along a V-V line shown in FIG. 4.
Figure 6:
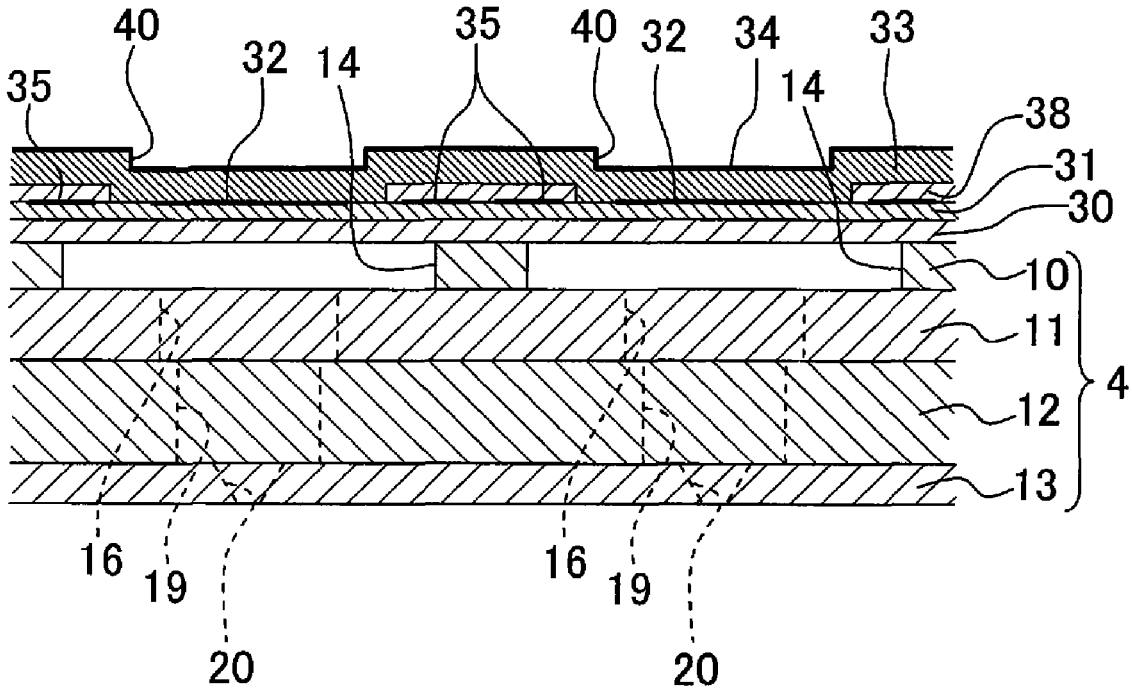
FIG. 6 shows a sectional view taken along a VI-VI line shown in FIG. 4.

Next, the ink-jet head 1 will be explained. FIG. 2 shows a plan view illustrating the ink-jet head. FIG. 3 shows a plan view illustrating a channel unit. FIG. 4 shows a partial magnified plan view illustrating those shown in FIG. 2. FIG. 5 shows a sectional view taken along a line V-V shown in FIG. 4. FIG. 6 shows a sectional view taken along a VI-VI line shown in FIG. 4. The explanation will be made below while giving a definition that the front side in relation to the direction perpendicular to the plane of paper of FIG. 2 resides in the upward direction, and the back side resides in the downward direction. As shown in FIGS. 2 to 6, the ink-jet head 1 of this embodiment includes the channel unit (flow passage unit) 4 which is formed with the ink channels (ink flow passages) including the plurality of nozzles 20, and a piezoelectric actuator 5 which is arranged on the upper surface of the channel unit 4.

At first, the channel unit 4 will be explained. As shown in FIGS. 2 to 6, the channel unit 4 includes four plates of a cavity plate 10, a base plate 11, a manifold plate 12, and a nozzle plate 13. The four plates 10 to 13 are stacked and joined to one another. In particular, the cavity plate 10, the base plate 11, and the manifold plate 12 are substantially rectangular plates as viewed in a plan view, each of which is composed of a metal material such as stainless steel. Therefore, the ink channels which include, for example, a manifold 17 and pressure chambers 14 as described later on can be easily formed in the three plates 10 to 12 by means of the etching. The nozzle plate 13 is formed of, for example, a high molecular weight synthetic resin material such as polyimide. The nozzle plate 13 is joined to the lower surface of the manifold plate 12 by means of an adhesive. Alternatively, the nozzle plate 13 may be also formed of a metal material such as stainless steel in the same manner as the other three plates 10 to 12.

The plurality of pressure chambers 14, each of which is formed as a hole to penetrate through the plate 10, are formed for the cavity plate 10. As shown in FIGS. 2 and 3, the plurality of pressure chambers 14 are arranged in three arrays in the paper feeding direction. The respective pressure chambers 14 are formed to have substantially elliptic shapes as viewed in a plan view, and they are arranged so that the longitudinal direction thereof is parallel to the scanning direction.

As shown in FIGS. 3 and 4, communication holes 15, 16 are formed respectively at positions of the base plate 11 overlapped with the both ends in the longitudinal direction of each of the pressure chambers 14 as viewed in a plan view. Three manifolds 17 are formed in the manifold plate 12 corresponding to the three arrays of the pressure chambers 14. The respective manifolds 17 extend in the paper feeding direction (upward-downward direction as shown in FIG. 2) and they are overlapped with right halves of the pressure chambers 14 shown in FIG. 3 as viewed in a plan view. The ink is supplied to the respective manifolds 17 from an ink tank (not shown) via an ink supply port 18 formed in the cavity plate 10. Communication holes 19 are also formed at positions of the manifold plate 12 overlapped with the left ends of the respective pressure chambers 14 shown in FIG. 3 as viewed in a plan view. Further, the plurality of nozzles 20 are formed respectively in the nozzle plate 13 at positions overlapped with the left ends of the plurality of pressure chambers 14 as viewed in a plan view. The nozzles 20 are formed, for example, by applying the excimer laser processing to a substrate of a high molecular weight synthetic resin such as polyimide.

As shown in FIG. 5, the manifold 17 is communicated with the pressure chambers 14 via the communication holes 15. Further, the pressure chambers 14 are communicated with the nozzles 20 via the communication holes 16, 19. In this way, individual ink channels 21, which range from the manifolds 17 via the pressure chambers 14 to arrive at the nozzles 20, are formed in the channel unit 4.

Next, the piezoelectric actuator 5 will be explained. As shown in FIG. 2 and FIGS. 4 to 6, the piezoelectric actuator 5 includes a vibration plate 30 which is arranged on the upper surface of the channel unit 4 to cover the plurality of pressure chambers 14 therewith, a first insulating layer 31 which is formed on the upper surface of the vibration plate 30 (on the surface, of the vibration plate 30, not facing the pressure chambers 14), a plurality of individual electrodes 32 which are formed on the upper surface of the first insulating layer 31 corresponding to the plurality of pressure chambers 14 respectively, a piezoelectric layer 33 which is formed on the upper surface of the first insulating layer 31 to range over the plurality of individual electrodes 32, and a common electrode 34 which is formed on the upper surface of the piezoelectric layer 33.

The vibration plate 30 is a substantially rectangular metal plate composed of, for example, an iron-based alloy such as stainless steel, a copper-based alloy, a nickel-based alloy, or a titanium-based alloy. The vibration plate 30 is joined to the upper surface of the cavity plate 10 to cover the plurality of pressure chambers 14 therewith. The first insulating layer 31, which is composed of a ceramics material having a high coefficient of elasticity such as alumina, zirconia, or silicon nitride, is formed on the entire upper surface of the vibration plate 30. In other words, owing to the provision of the first insulating layer 31, the upper surface of the vibration plate 30 (surface disposed on the side opposite to the pressure chambers 14) is the surface (insulative surface) having the insulating property.

The plurality of individual electrodes 32, which have elliptic planar shapes that are one size smaller than those of the pressure chambers 14, are arranged on the upper surface of the first insulating layer 31. The individual electrodes 32 are formed of a conductive material including, for example, gold, platinum, palladium, and silver at positions overlapped with central portions of the corresponding pressure chambers 14 as viewed in a plan view. The electric insulation is effected by the first insulating layer 31 between the individual electrodes 32 and the vibration plate 30 made of metal and between the adjoining individual electrodes 32.

Further, a plurality of wiring sections 35 are provided on the upper surface of the first insulating layer 31, the wiring sections being led in the direction parallel to the longitudinal direction of the individual electrodes 32 respectively from first ends (right ends as shown in FIG. 2) of the plurality of individual electrodes 32. The respective wiring sections 35 extend in the rightward direction as shown in FIG. 2 from the corresponding individual electrodes 32 through the spaces between the another individual electrodes 32 other than the concerning individual electrodes 32 (inter-electrode areas). In other words, the wiring sections have inter-electrode portions passing the inter-electrode areas each of which is defined between two adjacent individual electrodes 32. Further, the plurality of wiring sections 35 are connected to a driver IC 37 which is carried on the upper surface of the vibration plate 30 at the right end. The wiring sections 35 of the individual electrodes 32 positioned at the utmost end in the wire leading direction (rightward direction as shown in FIG. 2) are connected to the driver IC 37 without passing through the spaces between the another individual electrodes 32. Any one electric potential of the two different types of electric potentials, i.e., the predetermined driving electric potential and the ground electric potential is selectively applied from the driver IC 37 via the wiring section 35 to each of the individual electrodes 32.

As shown in FIGS. 2 and 4, each of the wiring sections 35 is allowed to pass between the another individual electrodes 32 (in the vicinity of the another individual electrodes 32) other than the corresponding individual electrode 32. In this arrangement, a part of the wiring section 35 is also formed in the area (area A as shown in FIG. 4) facing another pressure chamber 14 corresponding to the another individual electrode 32. In other words, the part of the wiring section 35 is overlapped with the another pressure chamber 14 corresponding to the another individual electrode 32. In this way, the part of the wiring section 35 is arranged to be overlapped with the pressure chamber 14 as viewed in a plan view, and hence the area, in which the wiring section 35 can be arranged, can be widened between the adjoining individual electrodes 32. Therefore, a larger number of the wiring sections 35 can be allowed to pass between the two individual electrodes 32. Owing to this fact, it is easy to lay out the wiring sections 35. Further, it is possible to arrange the corresponding individual electrodes 32 and the pressure chambers 14 at a higher density.

As shown in FIGS. 4 and 5, a second insulating layer 38, which is composed of a ceramics material having a high coefficient of elasticity such as alumina, zirconia, or silicon nitride, is formed on the substantially entire upper surface of the vibration plate 30 except for the areas in which the individual electrodes 32 are arranged. In other words, the second insulating layer 38 is formed such that the plurality of individual electrodes 32 are surrounded thereby and the second insulating layer 38 covers almost all of the plurality of wiring sections 35 which are led from the plurality of individual electrodes 32 respectively and which extend to the driver IC 37. The reason, why the second insulating layer 38 is provided, will be described later on.

The piezoelectric layer 33 is arranged on the upper surface of the vibration plate 30 (first insulating layer 31) to continuously cover the plurality of individual electrodes 32, the plurality of wiring sections 35, and the second insulating layer 38. The piezoelectric layer 33 is composed of a piezoelectric material containing a main component of lead titanate zirconate (PZT) which is a ferroelectric substance and which is a solid solution of lead titanate and lead zirconate. The piezoelectric layer 33 is previously polarized in the thickness direction. As shown in FIG. 2, the piezoelectric layer 33 is provided in only the area facing the plurality of pressure chambers 14. The piezoelectric layer 33 is not provided in the area (area around the driver IC 37 at the right end in FIG. 2) which is not opposed to the pressure chambers 14. The second insulating layer 38, which covers the plurality of wiring sections 35, is exposed in this area.

As described above, the second insulating layer 38 is formed, on the upper surface of the vibration plate 30, to surround the plurality of individual electrodes 32. Further, the piezoelectric layer 33 is formed to cover the plurality of individual electrodes 32 and the second insulating layer 38. Therefore, as shown in FIGS. 4 to 6, the piezoelectric layer 33 is bulged in an amount corresponding to the thickness of the second insulating layer 33 in the area in which the second insulating layer 38 is present, as compared with other areas in which the individual electrodes 32 are arranged. In other words, recesses 40 are formed in the areas, of the upper surface of the piezoelectric layer 33, which overlap with the individual electrodes 32, the upper surface of the piezoelectric layer 33 at the recesses 40 being lower than the upper surface of the piezoelectric layer 33 at the surroundings of the recesses 40.

The common electrode 34 is formed on the entire upper surface of the piezoelectric layer 33 so that the common electrode 34 faces all of the individual electrodes 32. Accordingly, the areas, of the piezoelectric layer 33, overlapping with the pressure chambers 14 are interposed between the individual electrodes 32 disposed on the lower side of the area and the common electrode 34 disposed on the upper side of the area. The common electrode 34 is connected to the ground wiring of the driver IC 37 by means of one wiring section (not shown). The common electrode 34 is always retained at the ground electric potential. The common electrode 34 is also formed of a conductive material including, for example, gold, platinum, palladium, and silver in the same manner as the individual electrodes 32.

Next, an explanation will be made about the function of the piezoelectric actuator 5 during the jetting of the ink liquid droplets. When the driving electric potential is applied to a certain individual electrode 32 from the driver IC 37 via the wiring section 35, then the driving voltage (electric potential difference) is applied between the certain individual electrode 32 to which the driving electric potential is applied and the common electrode 34 which is retained at the ground electric potential, and the electric field is generated in the thickness direction in the piezoelectric layer 33 interposed between the both electrodes 32, 34. The direction of the electric field is parallel to the direction of polarization of the piezoelectric layer 33. Therefore, the area (active area), of the piezoelectric layer 33, which face the certain individual electrode 32, is shrunk in the in-plane direction perpendicular to the thickness direction (piezoelectric strain). In this arrangement, the vibration plate 30, which is disposed on the lower side of the piezoelectric layer 33, is fixed to the cavity plate 10. Therefore, the portion of the vibration plate 30, which covers a certain pressure chamber 14 corresponding to the certain individual electrode, is deformed (unimorph deformation) so that the portion protrudes toward the certain pressure chamber 14 in accordance with the shrinkage of the piezoelectric layer 33 in the in-plane direction, the piezoelectric layer 33 being positioned on the upper surface of the vibration plate 30. In this situation, the volume in the certain pressure chamber 14 is decreased, and hence the ink pressure in the certain pressure chamber 14 is raised. The ink is jetted from the nozzle 20 communicated with the certain pressure chamber 14.

When the driving electric potential is applied to a certain individual electrode 32 corresponding to a certain pressure chamber 14 in order to drive the certain pressure chamber 14 (deform the vibration plate 30), the electric potential is necessarily applied simultaneously to a certain wiring section 35 connected to the certain individual electrode 32 as well. Therefore, the electric field in the thickness direction is also allowed to act on the piezoelectric layer 33 in an area which is disposed between the another individual electrodes 32 and through which the certain wiring section 35 is allowed to pass. The piezoelectric strain is consequently generated in the concerning area. Accordingly, the influence thereof is exerted, and it is feared that the driving characteristic may be changed for the another pressure chambers 14 to be driven by the another individual electrodes 32 disposed near the certain individual electrode. Further, any pressure wave is generated in the another pressure chambers 14 for which the jetting is not scheduled. It is also feared that the ink may unintentionally leak from the nozzle 20.

In view of the above, in the piezoelectric actuator 5 according to the embodiment of the present invention, the plurality of wiring sections 35 are covered with the second insulating layer 38. Therefore, the occurrence of the piezoelectric strain is suppressed, which would be otherwise caused by the electric field allowed to act on the piezoelectric layer 33 interposed between the wiring section 35 and the common electrode 34 during the driving of the pressure chambers 14 (during the application of the driving electric potential to the individual electrodes 32). Further, the occurrence of the piezoelectric strain is suppressed between the wiring sections 35 and the common electrode 34, because the wiring sections 35 are covered with the second insulating layer 38. Therefore, it is unnecessary to apply any special artifice to the common electrode 34. Specifically, it is unnecessary to partially cut out the areas of the common electrode 34 overlapping with the wiring sections 35 unlike the conventional arrangement. In other words, according to the arrangement of the embodiment of the present invention, it is possible to form the common electrode 34 on the entire upper surface of the piezoelectric layer 33, and hence it is possible to stabilize the electric potential of the common electrode 34. Further, it is possible to suppress the occurrence of the piezoelectric strain in the area of the piezoelectric layer 33 between the adjoining individual electrodes 32 through which the wiring section 35 is allowed to pass.

In the embodiment of the present invention, the wiring sections 35 are covered with the second insulating layer 38 which is composed of, for example, alumina having a dielectric constant lower than that of the piezoelectric layer 33, in the area, of the upper surface of the vibration plate 30, in which the piezoelectric layer 33 is arranged. Not only the portion, of each of the wiring sections 35, which passes between the another individual electrodes 32, is covered with the second insulating layer 38, but the entire portion of each of the wiring sections 35 is also covered with the second insulating layer 38. Therefore, when the electric potential difference arises between the wiring sections 35 and the common electrode 34, the parasitic capacitance, which is generated in the piezoelectric layer 33 disposed between the both, is reduced.

Further, the second insulating layer 38 is provided to cover the wiring sections 35. Therefore, the piezoelectric layer 33 is bulged in the amount corresponding to the thickness of the second insulating layer 38 in the area, of the upper surface of the piezoelectric actuator 5, in which the second insulating layer 38 is present, as compared with the area in which the second insulating layer 38 is not provided (arrangement area of the individual electrode 32, the active area). In other words, the height of the upper surface of the piezoelectric layer 33 is lowered in the active area as compared with the surroundings of the active area. Therefore, the active area of the piezoelectric layer 33 is maximally prevented from being damaged, for example, by any contact with any external member, the active area facing the individual electrodes 32 and applying the pressure to the ink contained in the pressure chambers 14. Further, it is preferable that the second insulating layer 38 is formed to surround the individual electrodes 32, including the area in which the wiring sections 35 are not arranged, without being limited to the arrangement in which the second insulating layer 38 is provided in only the area in which the wiring section 35 is arranged. In this arrangement, the piezoelectric layer 33 is formed to be high to surround the entire circumference of the active area in which the individual electrode is arranged. That is, as shown in FIG. 4, each of the recesses 40 of the upper surface of the piezoelectric layer 33 has a closed shape. Accordingly, the active area of the piezoelectric layer 33 is damaged more scarcely. In this arrangement, it is preferable that the depth of the each of the recesses 40 is about 1 to 4 μm. In general, the dust or the like, which remains in the clean room, has a diameter of about 1 μm. Therefore, when the depth of the recesses 40 is about 1 to 4 μm, it is possible to avoid the breakage of the active area corresponding to each of the recesses 40, which would be otherwise caused such that the dust or the like, which flows in the clean room, is bitten.

As described above, when the part of the wiring section 35 is also formed in the area (area A shown in FIG. 4) opposed to the another pressure chambers 14 corresponding to the another individual electrodes 32 other than the individual electrode 32 to which the concerning wiring section 35 is connected, it is possible to arrange a large number of the wiring sections 35 between the individual electrodes 32. However, in a such viewpoint that the amount of displacement of the entire piezoelectric actuator 5 is increased by easily deforming the vibration plate 30 and the piezoelectric layer 33 in the area opposed to each of the pressure chambers 14, it is preferable that the thickness of the piezoelectric actuator 5 is decreased as small as possible in the area opposed to the pressure chamber 14. Therefore, it is intended to maximally decrease the area in which the second insulating layer 38 is provided. Accordingly, in the embodiment of the present invention, the second insulating layer 38 is arranged in only the area in which the wiring sections 35 are provided, in the area opposed to the pressure chambers 14. Specifically, as shown in FIGS. 4 to 6, the second insulating layer 38 is provided, on the upper surface of the vibration plate 30, at areas which face the pressure chambers 14, which are disposed on the both end sides in the transverse direction of the pressure chambers 14, and in which the wiring sections 35 are arranged. However, the second insulating layer 38 is not provided on the both end sides in the longitudinal direction of the pressure chambers 14. That is, the recesses 40 shown in FIG. 4 arrive at the both ends of the pressure chambers 14 in the longitudinal direction. Accordingly, it is possible to suppress the decrease in the amount of displacement of the actuator 5, which would be otherwise caused by the provision of the second insulating layer 38 on the pressure chambers 14.

As shown in FIG. 2, the wiring sections 35 extend from an area of the upper surface of the vibration plate 30 in which the piezoelectric layer 33 is arranged to the installation area of the driver IC 37 in which the piezoelectric layer 33 is not arranged. In the embodiment of the present invention, the second piezoelectric layer 38 is also formed in the area in which the piezoelectric layer 33 is not arranged to cover the portions, of the wiring sections 35, which are not covered with the piezoelectric layer 33. Therefore, the wiring sections 35 are also protected by the second insulating layer 38 in the area in which the piezoelectric layer 33 is not arranged. Further, any short circuit formation between the wiring sections 35 is also avoided.

Next, an explanation will be made with reference to FIGS. 7 and 8 about a method for producing the ink-jet head 1 of the embodiment of the present invention. At first, holes for constructing the ink channels including, for example, the pressure chambers 14 and the manifolds 17 are formed through the cavity plate 10, the base plate 11, and the manifold plate 12 which are included in the plates for constructing the channel unit 4. The plates 10 to 12 are composed of the metal material. Therefore, the holes for forming the ink channels can be easily formed by means of the etching.

Figure 7A:
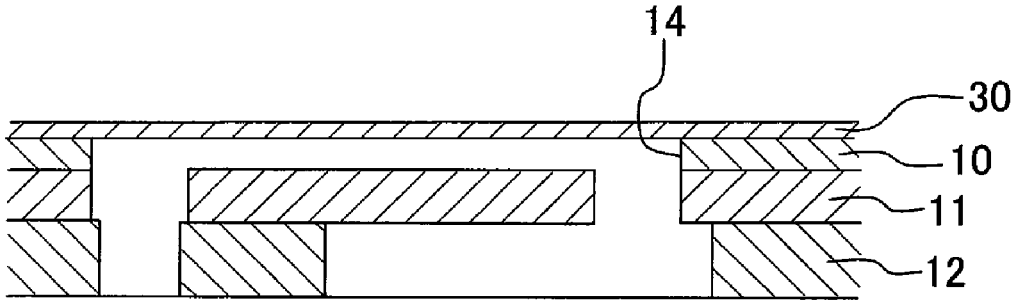

As shown in FIG. 7A, the four metal plates, i.e., the vibration plate 30, the cavity plate 10, the base plate 11, and the manifold plate 12 are stacked and joined to one another. In the joining step, for example, the stacked plates are pressurized while being heated to a temperature of not less than a predetermined temperature (for example, 1000° C.). Accordingly, the four plates can be joined by means of the metal diffusion bonding.

Figure 7B:
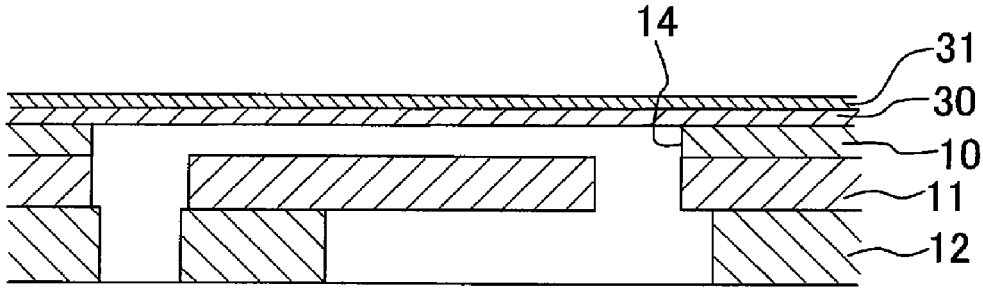

Subsequently, as shown in FIG. 7B, the first insulating layer 31 is formed in the entire region of the upper surface of the vibration plate 30 (first insulating layer-forming step). In this procedure, when the insulative ceramics material such as alumina and zirconia is used as the first insulating layer 31, the particles of the ceramics material are deposited on the upper surface of the vibration plate 30 by means of, for example, the aerosol deposition method (AD method), the sputtering method, or the chemical vapor deposition method (CVD method). Accordingly, it is possible to form the first insulating layer 31. Among the methods described above, it is especially preferable to adopt the AD method.

The AD method is such a film formation method that the mixture (aerosol) of the gas (carrier gas) and the particles for forming the film is allowed to blow against the substrate as the film formation objective, and the particles are deposited on the substrate by allowing the particles to collide with the substrate at the high velocity. The densified first insulating layer 31, which has a high mechanical strength, can be formed by using the AD method.

Figure 7C:
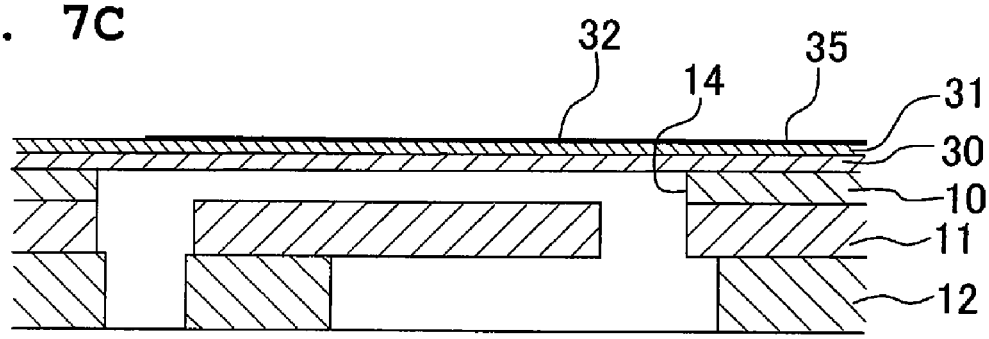

Subsequently, as shown in FIG. 7C, the plurality of individual electrodes 32 are formed respectively in the areas which are opposed to the plurality of pressure chambers 14 and which are disposed on the upper surface of the vibration plate 30 covered with the first insulating layer 31 (individual electrode-forming step). The plurality of wiring sections 35, which extend from the plurality of individual electrodes 32 respectively, are formed on the upper surface of the vibration plate 30 as well (wiring section-forming step). In this procedure, as shown in FIG. 2, the plurality of wiring sections 35 are led in the rightward direction from the ends of the corresponding individual electrodes 32 in the longitudinal direction. Further, the respective wiring sections 35, from which the wiring sections 35 of the individual electrodes 32 positioned at the rightmost end are excluded, are allowed to pass through the areas disposed between the another individual electrodes 32 other than the corresponding individual electrodes 32. The plurality of individual electrodes 32 and the plurality of wiring sections 35 can be formed at the same time by means of, for example, the screen printing, the vapor deposition method, or the sputtering method.

Figure 7D:
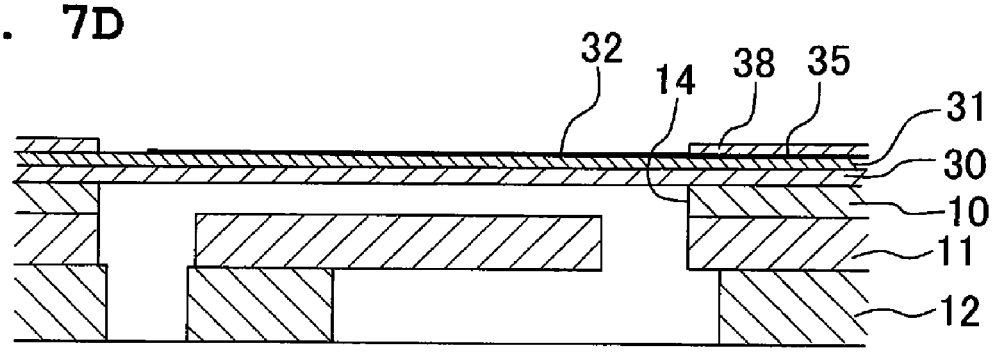

Further, as shown in FIG. 7D, the second insulating layer 38 is formed in the substantially entire area of the upper surface of the vibration plate 30 covered with the first insulating layer 31 except for the areas in which the plurality of individual electrodes 32 are formed (second insulating layer-forming step). That is, the second insulating layer 38 is formed so that the plurality of individual electrodes 32 are surrounded and all of the plurality of wiring sections 35 are covered.

When the second insulating layer 38 is formed by using the insulative ceramics material such as alumina and zirconia in the same manner as the first insulating layer 31, then the particles of the ceramics material are deposited on the upper surface of the vibration plate 30 by means of, for example, the aerosol deposition method (AD method), the sputtering method, or the chemical vapor deposition method (CVD method), and thus the second insulating layer 38 can be formed. Among the various film formation method as described above, it is preferable to adopt the AD method in view of the fact that the densified second insulating layer 38, which has a high mechanical strength, can be formed.

Figure 8A:
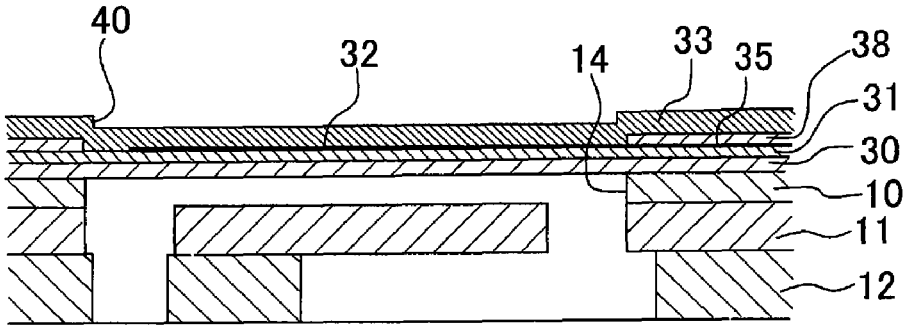

Subsequently, as shown in FIG. 8A, the piezoelectric layer 33 is formed on the upper surface of the vibration plate 30 covered with the first insulating layer 31 so that the plurality of individual electrodes 32, the plurality of wiring sections 35, and the second insulating layer 38 are covered therewith (insulating layer-forming step). The piezoelectric layer 33 can be formed by means of, for example, the aerosol deposition method (AD method), the sputtering method, the chemical vapor deposition method (CVD method), or the sol-gel method.

In this procedure, the second insulating layer 38 is formed on the entire surface of the vibration plate 30 except for the areas in which the individual electrodes 32 are arranged. Therefore, when the piezoelectric layer 33 is formed thereon to have a substantially uniform thickness by means of, for example, the AD method, the recesses 40, in which the upper surface of the piezoelectric layer 33 is lower than the surroundings, are formed in the areas in which the individual electrodes 32 are arranged.

Figure 8B:
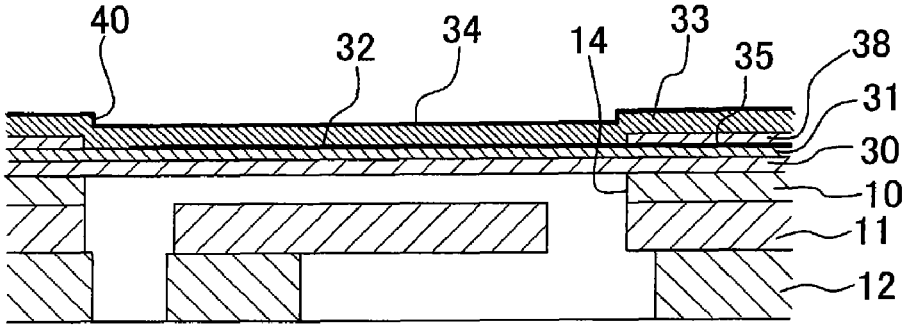

Subsequently, as shown in FIG. 8B, the common electrode 34 is formed in the entire region of the upper surface of the piezoelectric layer 33. The common electrode 34 can be formed by means of, for example, the vapor deposition method or the sputtering method. As described above, the plurality of wiring sections 35 are covered with the second insulating layer 38. Therefore, it is unnecessary to partially cut out the common electrode 34 in the areas overlapped with the wiring sections 35 in order to avoid the occurrence of the piezoelectric strain in the piezoelectric layer 33 interposed between the wiring sections 35 and the common electrode 34.

Figure 8C:
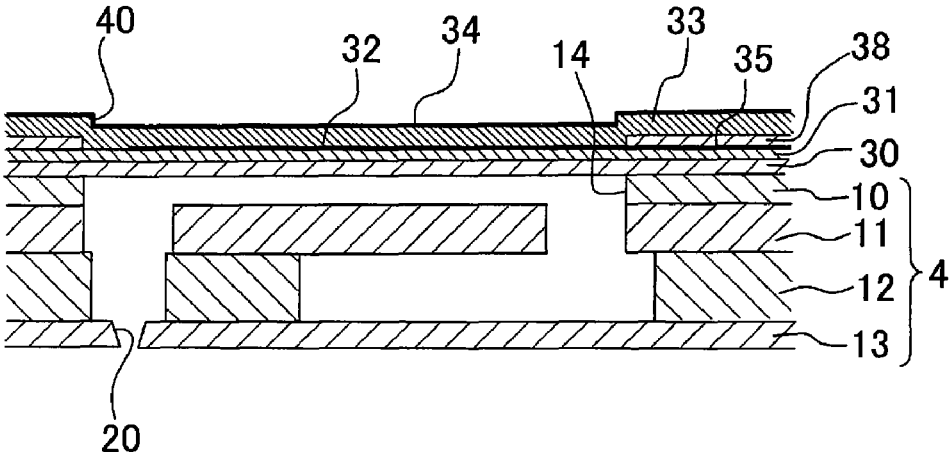

Finally, as shown in FIG. 8C, the plurality of nozzles 20 are formed for the nozzle plate 13 made of the synthetic resin by means of, for example, the laser processing. After that, the nozzle plate 13 is joined to the lower surface of the manifold plate 12 by means of, for example, an adhesive.

The nozzle plate 13 may be formed of a metal material such as stainless steel in the same manner as the other three plates 10 to 12 for constructing the channel unit 4. In this case, the nozzle plate 13 may be joined at the same time together with the plates 10 to 12 and the vibration plate 30 in the plate-joining step shown in FIG. 7A. Even when the nozzle plate 13 is formed of the synthetic resin material, if the plates 10 to 12 made of metal and the vibration plate 30 are joined to one another by using a thermosetting adhesive, then the plates 10 to 12 and the vibration plate 30 and the nozzle plate 13 can be joined to one another at the same time, because the joining temperature is low.

Alternatively, the piezoelectric actuator 5 may be joined to the channel unit 4 after completing the manufacturing of the piezoelectric actuator 5 by stacking, for example, the piezoelectric layer 33 on the vibration plate 30 before joining the vibration plate 30 to the cavity plate 10 of the channel unit 4.

Next, an explanation will be made about modified embodiments in which various modifications are applied to the embodiment described above. However, those constructed in the same manner as those of the embodiment described above are designated by the same reference numerals, any explanation of which will be appropriately omitted.

Figure 9:
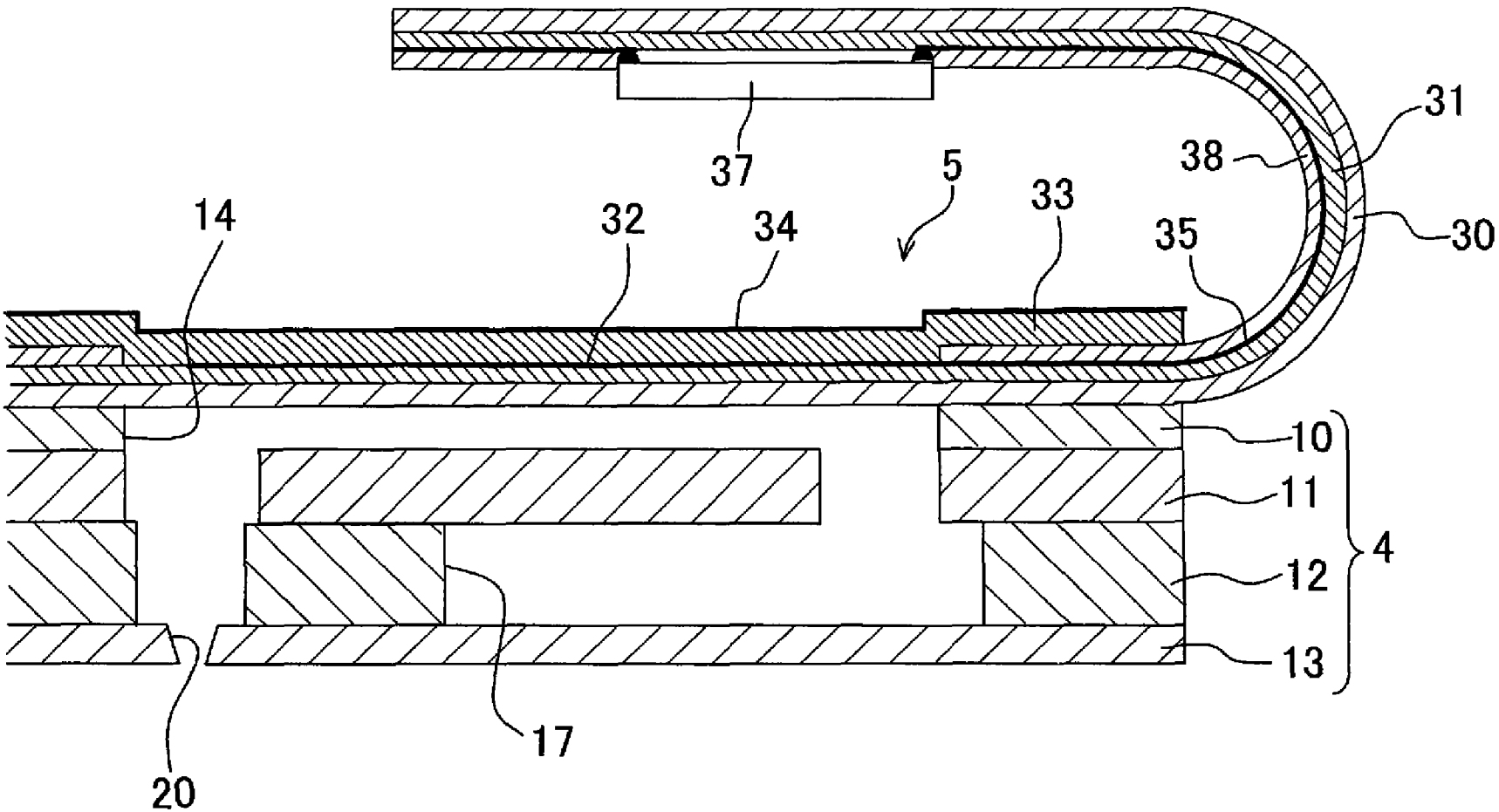
FIG. 9 shows a sectional view illustrating an ink-jet head of a modified embodiment corresponding to FIG. 5.

In a first modified embodiment, as shown in FIG. 9, the area of the vibration plate 30, in which the piezoelectric layer 33 is arranged, may be fixed to the upper surface of the channel unit 4 to cover the plurality of pressure chambers 14 therewith, while the area, in which the piezoelectric layer 33 is not arranged, may be allowed to extend to the outside of the channel unit 4, and the driver IC 37 (driving circuit), which is connected to the plurality of wiring sections 35 covered with the second insulating layer 38, may be further carried on the extended portion. In this way, when the part of the vibration plate 30 is used as the wiring board provided with the plurality of wiring sections 35 and the driver IC 37 connected thereto, it is preferable that the portion, which is used as the wiring board, is maximally thinned so that the portion can be easily curved and laid out. Accordingly, in the embodiment shown in FIG. 9, the piezoelectric layer 33 is not formed on the portion of the vibration plate 30 which extends to the outside from the channel unit 4 and which is used as the wiring board.

Figure 10:
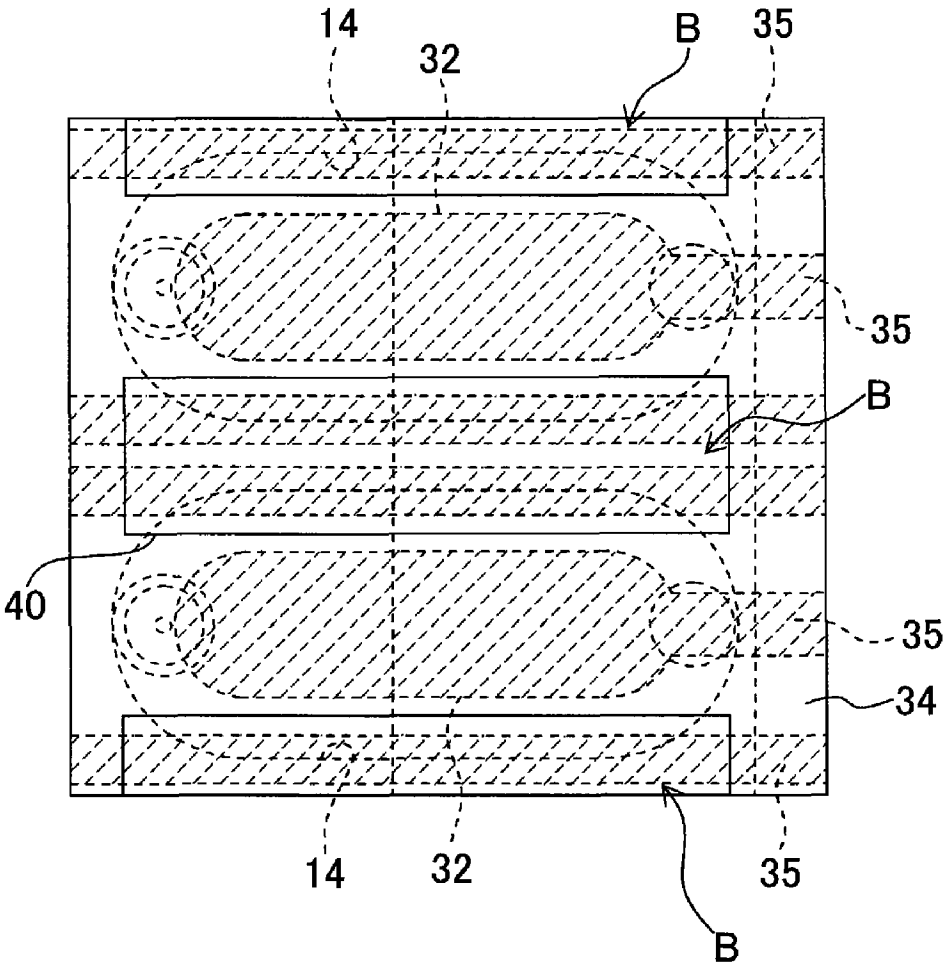
FIG. 10 shows a partial magnified plan view illustrating an ink-jet head of another modified embodiment corresponding to FIG. 4.

When the piezoelectric strain is generated in the piezoelectric layer 33 interposed between a certain wiring section 35 and the common electrode 34, the piezoelectric strain, which is generated at the portion of the piezoelectric layer 33 disposed closely to the individual electrode 32, exerts the worst influence on the another pressure chambers 14. That is, the piezoelectric strain generated at the portion allowed to pass between the individual electrodes 32 exerts the worst influence on the another pressure chambers 14. Accordingly, in a second modified embodiment, as shown in FIG. 10, the second insulating layer 38 may be formed in only the area (area B shown in FIG. 10) in which the wiring section 35 is allowed to pass between the another individual electrodes 32. Even in this case, the height position of the upper surface of the piezoelectric layer 33, which is provided in the active area arranged to be overlapped with the individual electrodes 32, is lower than those of the areas (areas B) disposed on the both sides in the transverse direction (a direction orthogonal to the longitudinal direction) of the pressure chamber 14, and the recess 40 is formed in the active area. Therefore, the piezoelectric layer 33 of the active area is prevented from being damaged.

Figure 11:
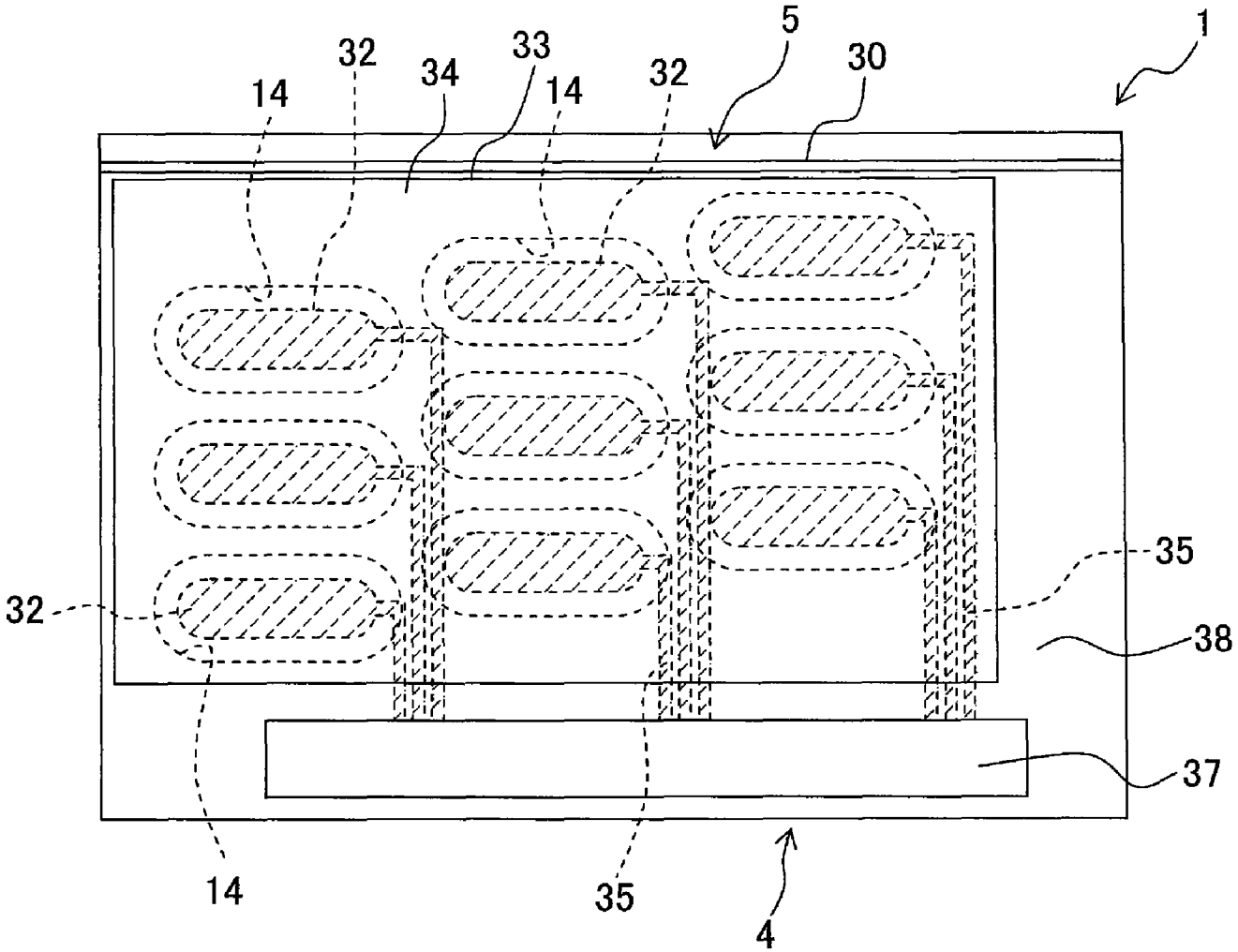
FIG. 11 shows a plan view illustrating an ink-jet head of still another modified embodiment corresponding to FIG. 2.

In the embodiment and the modified embodiments described above, the wiring sections 35 extend in the longitudinal direction of the pressure chambers between the individual electrodes 32. However, as shown in FIG. 11, for example, the wiring sections 35 may extend in the transverse direction substantially perpendicular to the longitudinal direction of the pressure chambers between the individual electrodes 32. Also in this arrangement, it is appropriate that the second insulating layer is formed to cover at least the portions of the wiring sections 35 overlapped with the pressure chambers 14. The direction, in which the wiring sections 35 extend between the individual electrodes 32, is not limited thereto, which may be set arbitrarily.

Figure 12:
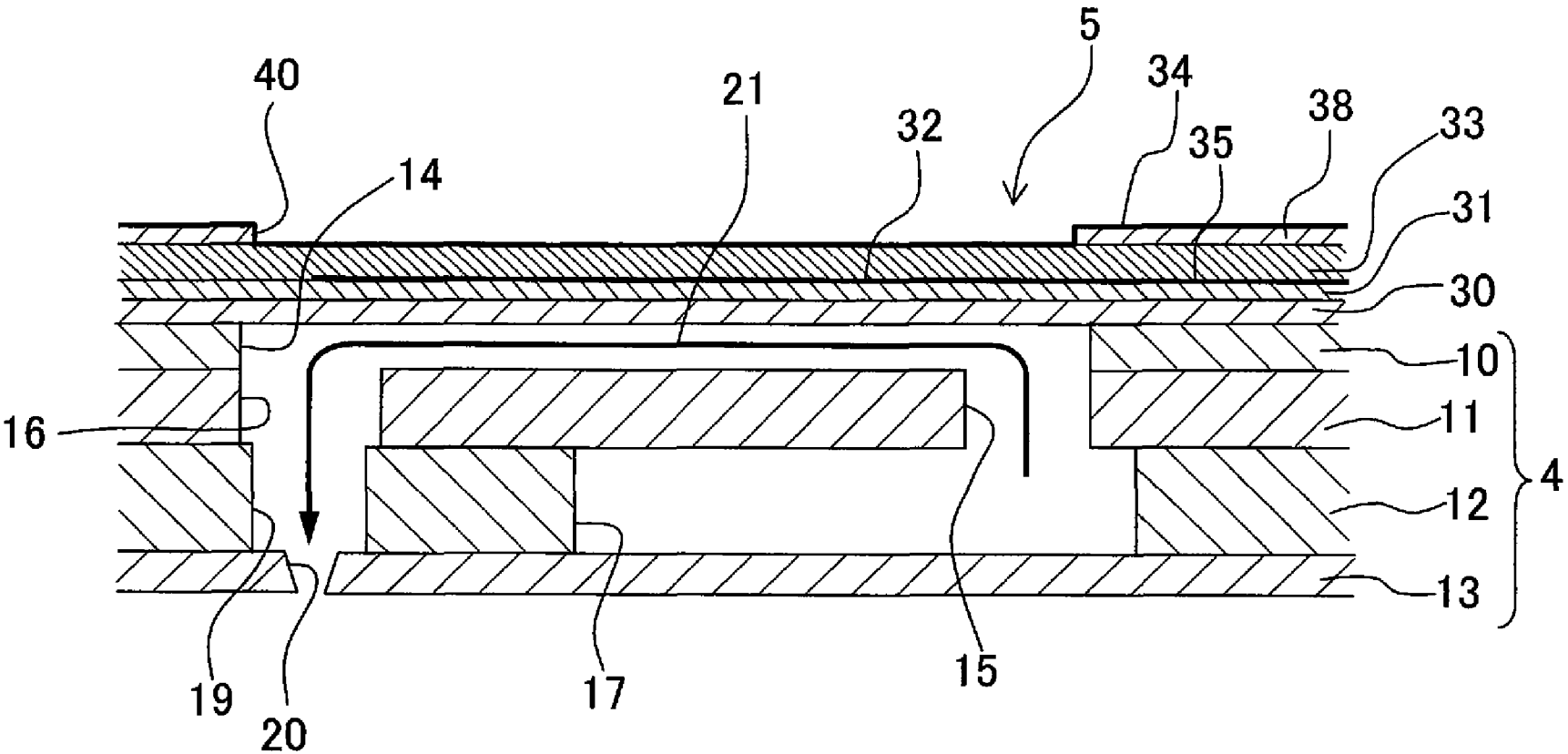
FIG. 12 shows a sectional view illustrating an ink-jet head of still another modified embodiment corresponding to FIG. 5.

In the foregoing description, the second insulating layer 38 is directly stacked on the wiring sections 35. In other words, the second insulating layer 38 and the wiring sections 35 are stacked so that they are in contact with each other. However, the present invention is not limited thereto. As shown in FIG. 12, for example, the piezoelectric layer 33 may be stacked on the wiring sections 35, the second insulating layer 38 may be stacked on the area, of the upper surface of the piezoelectric layer 33, not overlapped with the individual electrodes 32 as viewed in a plan view, and the common electrode 34 may be formed on the upper surfaces of the piezoelectric layer 33 and the second insulating layer 38. Even in the case of this arrangement, it is possible to avoid the occurrence of any unintentional piezoelectric strain which would be otherwise caused such that the electric field is generated in the areas of the piezoelectric layer 33 disposed between the wiring sections 35 and the common electrode 34.

As described above, it is appropriate that the second insulating layer 38 is arranged between the wiring sections 35 and the common electrode 34 in the stacking direction in which, for example, the wiring sections 35, the common electrode 34, and the piezoelectric layer 33 are stacked. For example, when the piezoelectric layer 33 is formed by stacking a plurality of piezoelectric layers, the second insulating layer 38 may be formed on an upper surface of any one of the piezoelectric layers. When the second insulating layer 38 is arranged between the wiring sections 35 and the common electrode 34 in the stacking direction, it is possible to avoid the occurrence of any unintentional piezoelectric strain which would be otherwise caused such that the electric field is generated in the areas of the piezoelectric layer 33 disposed between the wiring sections 35 and the common electrode 34. Even when the second insulating layer 38 is arranged between the wiring sections 35 and the common electrode 34 in the stacking direction as described above, the area of the upper surface of the piezoelectric actuator 5 (upper surface of the common electrode 34), which is overlapped with the second insulating layer 38, is higher than the area which is overlapped with the individual electrode 32. Therefore, it is possible to protect the areas of the upper surface of the piezoelectric actuator 5 overlapped with the individual electrodes 32 in the same manner as in the embodiment described above. Also in this arrangement, it is appropriate that the second insulating layer is formed to cover at least the portions of the wiring sections 35 overlapped with the pressure chambers 14.

In the embodiment described above, the vibration plate 30 is the metal plate. The first insulating layer 31 is provided on the vibration plate 30 in order that the upper surface of the vibration plate 30 is provided as the insulative surface to make it possible to arrange the plurality of individual electrodes 32 and the plurality of wiring sections 35. However, when the vibration plate 30 is formed of an insulative material such as a ceramics material or a resin material, it is unnecessary to provide the first insulating layer 31. Alternatively, it is also possible to adopt a vibration plate made of silicon. In this case, a first insulating layer 31 composed of a silicon oxide film may be formed by partially oxidizing the upper surface of the vibration plate 30. The first insulating layer 31 composed of the silicon oxide film may be formed on the upper surface of the vibration plate 30 made of silicon, the individual electrodes 32, the wiring sections 35, and the second insulating layer 38 may be formed as described in the foregoing embodiment, and the piezoelectric layer 33 may be formed by means of the sol-gel method. In this case, the first insulating layer 31 is not limited to the silicon oxide film. The first insulating layer 31 may be an insulative ceramics such as alumina or zirconia in the same manner as in the embodiment described above.

In the embodiment and the modified embodiments described above, the first insulating layer 31, which is made of the insulative ceramics such as alumina or zirconia and which is formed on the surface of the vibration plate made of metal or silicon, also functions as the diffusion-preventive layer which prevents the constitutive atoms of the vibration plate 30 from being diffused into the piezoelectric layer 33. It is necessary to perform the annealing treatment for the piezoelectric layer 33, for example, such that the piezoelectric layer 33 is heated to a high temperature of not less than 850° C. in order to allow the piezoelectric layer 33 to possess the piezoelectric characteristic after forming the piezoelectric layer 33 by means of, for example, the AD method. In this procedure, the vibration plate 30 is also heated. Therefore, the atoms, which constitute the vibration plate 30, tend to be diffused. It is known that the piezoelectric characteristic is deteriorated if the atoms, which constitute the vibration plate 30, are diffused into the piezoelectric layer 33. However, when the first insulating layer 31, which is made of the insulative ceramics, is formed on the surface of the vibration plate 30 opposed to the piezoelectric layer 33, the first insulating layer 31 functions as the diffusion-preventive layer (barrier layer) which prevents the constitutive atoms of the vibration plate 30 from being diffused into the piezoelectric layer 33. Therefore, it is possible to avoid the deterioration of the piezoelectric characteristic of the piezoelectric layer 33.

In the embodiment and the modified embodiments described above, the individual electrodes are formed on the insulative surface of the vibration plate (on the surface disposed on the side opposite to the pressure chambers), and the common electrode is formed on the surface of the piezoelectric layer disposed on the side opposite to the vibration plate. In this arrangement, the individual electrodes are not exposed on the surface of the piezoelectric actuator. Therefore, there is no fear of the electric short circuit formation between the individual electrodes and the other elements. As described above, the surface of the vibration plate has the insulation performance or the insulating property, and the individual electrodes and the wirings are formed on the insulative surface. Therefore, it is possible to omit the high cost wiring members such as FPC unlike a case in which the individual electrodes are formed on the surface of the actuator.

The present invention has been explained above as exemplified by the examples as the embodiments of the present invention in which the present invention is applied to the ink-jet head for jetting the inks from the nozzles by applying the pressure to the inks contained in the ink channels. However, the present invention is not limited to such an ink-jet head. That is, the present invention is also applicable to liquid transport apparatuses to be used in various fields in which any liquid other than the ink, for example, any liquid such as a reagent solution, a chemical solution, or a coolant or refrigerant is transported to a predetermined position for any purpose other than the purpose of jetting the liquid droplets to the outside.

What is claimed is:

1. A liquid transport apparatus which transports a liquid, comprising:

a channel unit in which a liquid channel including a plurality of pressure chambers arranged along a plane is formed; and a piezoelectric actuator which applies a pressure to the liquid in each of the pressure chambers, the piezoelectric actuator including:

a vibration plate which is arranged on a surface of the channel unit to cover the pressure chambers and one surface of which has an insulation property, the one surface not facing the pressure chambers;

a plurality of individual electrodes which are arranged on the one surface of the vibration plate at areas facing the pressure chambers, respectively, to define inter-electrode areas each of which is defined between two adjacent individual electrodes, among the individual electrodes;

a plurality of wirings which are arranged on the one surface of the vibration plate, the wirings extending from the respective individual electrodes and passing the inter-electrode areas;

a piezoelectric layer which is arranged, on a side, of the vibration plate, not facing the pressure chambers, to be overlapped with the individual electrodes and portions of the wirings passing the inter-electrode areas;

a common electrode which is arranged on one surface, of the piezoelectric layer, not facing the vibration plate to be overlapped with the individual electrodes and the portions of the wirings passing the inter-electrode areas; and an insulating layer which is arranged between the wirings and the common electrode to be overlapped with the portions of the wirings passing the inter-electrode areas.

2. The liquid transport apparatus according to claim 1, wherein the insulating layer is arranged to directly cover the portions of the wirings passing the inter-electrode areas.

3. The liquid transport apparatus according to claim 1, wherein first areas and a second area are formed on a surface of the common electrode not facing the piezoelectric layer, the first areas being formed to overlap with the individual electrodes, and to be located at a position lower, in a direction directed from the vibration plate to the common electrode, than the second area which is overlapped with the insulating layer.

4. The liquid transport apparatus according to claim 3, wherein the second area of the common electrode is arranged to surround a circumference of each of the first areas, and each of the first areas of the common electrode is formed as a recess.

5. The liquid transport apparatus according to claim 1, wherein an area of the wiring, which is overlapped with the piezoelectric layer, is entirely covered with the insulating layer.

6. The liquid transport apparatus according to claim 1, wherein the piezoelectric layer is arranged in only a partial area of the one surface of the vibration plate;

each of the wirings extends to an area, of the one surface of the vibration plate, in which the piezoelectric layer is absent; and each of the wirings is covered with the insulating layer also in the area in which the piezoelectric layer is absent.

7. The liquid transport apparatus according to claim 6, wherein the partial area of the vibration plate, in which the piezoelectric layer is arranged, is fixed to the surface of the channel unit; and another area of the vibration plate, which is different from the partial area, extends toward outside of the channel unit, and a driving circuit, which is connected to the plurality of wirings and which applies a driving voltage between the individual electrodes and the common electrode, is provided on the another area.

8. The liquid transport apparatus according to claim 1, wherein the insulating layer is arranged, on the one surface of the vibration plate, to surround the individual electrodes.

9. The liquid transport apparatus according to claim 7, wherein a portion of each of the wirings is formed in areas facing another pressure chambers corresponding to another individual electrodes which is different from the respective individual electrodes; and the insulating layer is formed on the one surface of the vibration plate at only areas which face the another pressure chambers and in which the wirings are arranged.

10. The liquid transport apparatus according to claim 1, wherein the insulating layer is arranged also in areas, between the wirings and the common electrode, not overlapped with the plurality of wirings.

11. The liquid transport apparatus according to claim 4, wherein the recess of the actuator has a depth of 1 to 4 μm.

12. The liquid transport apparatus according to claim 1, wherein the vibration plate has a metal substrate which is arranged to face the pressure chambers, and an insulating film which is formed on a surface of the substrate not facing the pressure chambers.

13. The liquid transport apparatus according to claim 12, wherein the insulating film is formed of a ceramics material.

14. A method for producing a liquid transport apparatus including a channel unit having a liquid channel formed therein and including a plurality of pressure chambers arranged along a plane, and a piezoelectric actuator which applies a pressure to a liquid in each of the pressure chambers, the method comprising:

providing the channel unit;

arranging a vibration plate on a surface of the channel unit to cover the plurality of pressure chambers, one surface of the vibration plate not facing the pressure chambers having an insulation property;

forming a plurality of individual electrodes on the one surface of the vibration plate at areas to be faced to the plurality of pressure chambers respectively;

forming a plurality of wirings on the one surface of the vibration plate to extend from the respective individual electrodes such that the wirings passes through inter-electrode areas each of which is defined between two adjacent individual electrodes among the individual electrodes;

forming a piezoelectric layer on the one surface of the vibration plate such that the piezoelectric layer is overlapped with the individual electrodes and portions of the wirings passing the inter-electrode areas;

forming a common electrode on a surface of the piezoelectric layer not facing the vibration plate such that the common electrode is overlapped with the individual electrodes; and forming an insulating layer between the common electrode and the wirings such that the insulating layer is overlapped with the portions, of the wirings, passing the inter-electrode areas.

15. The method for producing the liquid transport apparatus according to claim 14, wherein the insulating layer is formed by an aerosol deposition method.

16. The method for producing the liquid transport apparatus according to claim 14, wherein the insulating layer is formed between the piezoelectric layer and the wirings to directly cover the portions, of the wirings, passing the inter-electrode areas.

* * * * *